US007716875B2

(12) United States Patent
Langner

(10) Patent No.: US 7,716,875 B2
(45) Date of Patent: May 18, 2010

(54) WINDOWS

(75) Inventor: Robert Langner, Nunawading (AU)

(73) Assignee: Aneeta Window Systems (Vic) Pty Ltd, Nunawading (AU)

( * ) Notice: Subject to any disclaimer, the term of this patent is extended or adjusted under 35 U.S.C. 154(b) by 260 days.

(21) Appl. No.: 11/466,341

(22) Filed: Aug. 22, 2006

(65) Prior Publication Data

US 2007/0107331 A1 May 17, 2007

(30) Foreign Application Priority Data

Apr. 8, 2004 (AU) ..... 2004901926

(51) Int. Cl.
*E05D 15/06* (2006.01)

(52) U.S. Cl. ..... 49/458; 52/204.51; 49/501

(58) Field of Classification Search ..... 49/458, 49/501; 52/204.6, 204.62, 204.69, 204.7, 52/204.51
See application file for complete search history.

(56) References Cited

U.S. PATENT DOCUMENTS 2,050,733 A * 8/1936 Ross ..... 52/204.593
2,205,522 A * 6/1940 Fix ..... 52/203
3,105,576 A * 10/1963 Jones et al. ..... 49/172
4,454,703 A * 6/1984 Sitzler et al. ..... 52/786.1
4,674,246 A * 6/1987 Giguere ..... 52/204.51
4,726,147 A * 2/1988 Beske et al. ..... 49/406
5,024,023 A * 6/1991 Kostos et al. ..... 49/501
5,033,249 A * 7/1991 Scheeren et al. ..... 52/786.13
5,111,618 A * 5/1992 Kaspar et al. ..... 49/501
5,199,761 A * 4/1993 Dannecker et al. ..... 296/146.16
5,270,084 A * 12/1993 Parker ..... 428/34
5,274,955 A * 1/1994 Dallaire et al. ..... 49/406
5,363,611 A * 11/1994 Richardson et al. ..... 312/116
5,446,997 A * 9/1995 Simonton ..... 49/458
5,456,054 A * 10/1995 Coupet ..... 52/773
5,910,083 A * 6/1999 Richardson et al. ..... 52/171.1
5,950,398 A * 9/1999 Hubbard ..... 52/786.1
6,055,783 A * 5/2000 Guhl et al. ..... 52/204.62
6,101,783 A * 8/2000 Howes ..... 52/786.11
6,463,706 B1 * 10/2002 Guhl et al. ..... 52/204.62
6,637,093 B2 * 10/2003 Richardson et al. ..... 29/458
6,889,480 B2 * 5/2005 Guhl et al. ..... 52/786.1
7,293,391 B2 * 11/2007 Guhl et al. ..... 52/204.593

(Continued)

FOREIGN PATENT DOCUMENTS

AU 681864 10/1994

(Continued)

*Primary Examiner*—Jerry Redman
(74) *Attorney, Agent, or Firm*—Workman Nydegger

(57) ABSTRACT

A window includes at least one multiple pane unit (1, 2) mounted in an opening for sliding movement between an open position and a closed position. The multiple pane unit (1, 2) includes at least two panes (34, 38) in spaced disposition, and has a seal (30) disposed there between to form a sealed chamber between the two panes. At least one of the panes (38) extends beyond the seal (30). In an alternative aspect of the invention, there may be two such multiple pane units (1, 2) in a sliding or other type of window. In the closed positions of the window, portions of the seal (30) of the multiple pane units are aligned and one of the multiple pane units (1) has at least one of its panes (38) extending beyond the seal (30).

16 Claims, 10 Drawing Sheets

U.S. PATENT DOCUMENTS

2003/0200718 A1* 10/2003 Ito ..... 52/716.5
2004/0231255 A1* 11/2004 Silverman ..... 52/204.6

FOREIGN PATENT DOCUMENTS

AU 755903 9/2000
AU 756048 9/2000
NZ 260317 9/1997

* cited by examiner

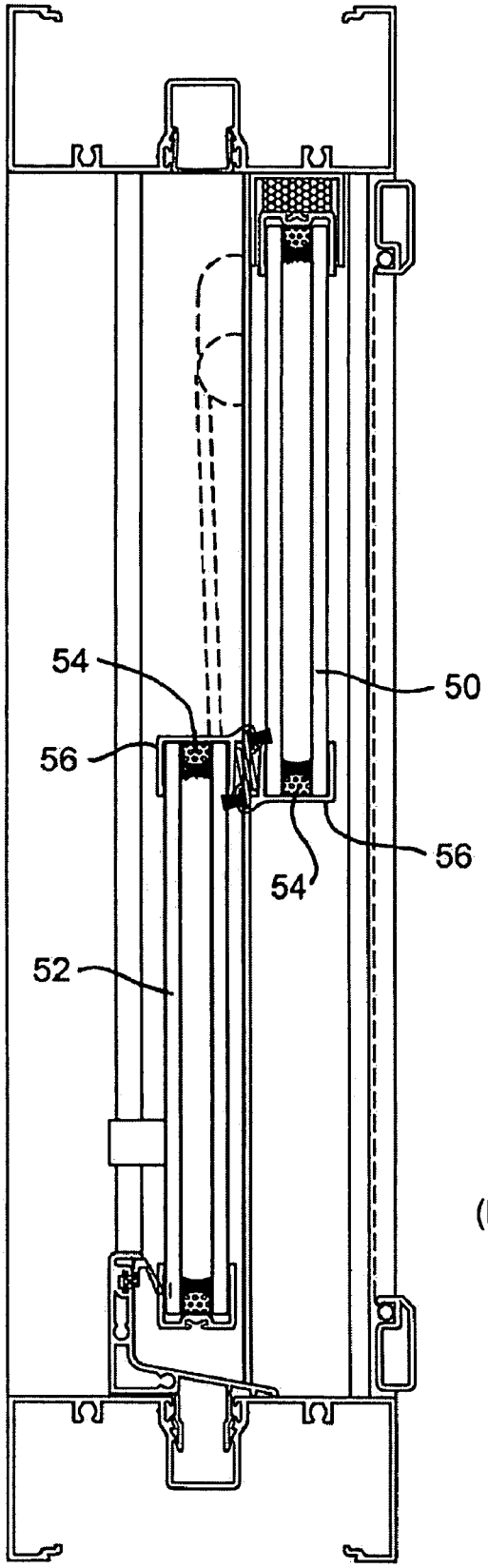
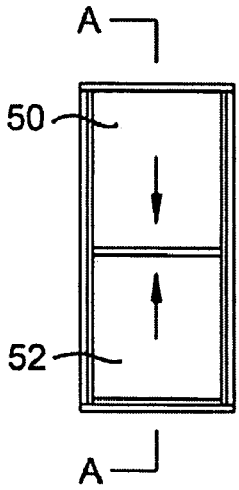
FIG 3
(PRIOR ART)
FIG 4
(PRIOR ART)

WINDOWS

CROSS-REFERENCE TO RELATED APPLICATIONS

Not applicable.

BACKGROUND OF THE INVENTION

1. The Field of the Invention

This invention relates to windows and in particular to windows with multiple pane units having two or more spaced panes. For example, a multiple pane unit having two spaced panes is commonly referred to as a double glazed unit. In particular, although not exclusively, the invention may be applied to the type of window known as a "double hung" window. Additionally, the invention may be applied to horizontal sliding windows. The invention is also not limited to windows in the conventional sense but may be used in any glazed opening such as a glazed opening in a door panel for instance.

2. The Relevant Technology

FIGS. 1 to 4 illustrate a cross section through known form of a double hung window with top 50 and bottom 52 double glazed units. It can be seen that the double glazed units possess a peripheral seal 54 between each of the two panes of glass and additionally, each double glazed unit has a top and bottom rail 56 of an extruded aluminium section. It will be appreciated that in the closed position of the window as shown in FIG. 4, the aligned top and bottom rails 56 will present an obvious visual barrier and will somewhat detract from the view through the window.

FIGS. 5 and 6 also illustrate another form of sashless window having horizontal sliding glass panels 58, 60. FIGS. 5 and 6 only illustrate a single glass panel. However, it will be appreciated that this form of window may be adapted for double glazed units, in which case the visual impediment presented by extruded aluminium rails extending vertically in the centre of the window will be present.

It is therefore an object of the present invention to provide a window which addresses the foregoing disadvantages or at least provides the public with a useful choice of available products.

SUMMARY OF THE INVENTION

In accordance with the first aspect of the present invention there is provided a window including at least one multiple pane unit mounted in an opening for sliding movement between an open position and a closed position, wherein the multiple pane unit includes at least two panes in spaced disposition, and has a seal disposed therebetween to form a sealed chamber between the two panes, wherein at least one of the panes extends beyond the seal.

Preferably, the extension is so as to overlap another multiple pane unit.

It should be appreciated that the panes of the windows need not necessarily be made of glass. They may, for example, be made of a transparent plastics material, or even of an opaque material so as to form a hatch rather than a "see-through" window. Therefore the term "pane" as used herein, is to be taken to refer to a pane formed of any type of material, glass or otherwise.

Each multiple pane unit may comprise double glazed units or alternatively there may be three or more panes of glass or other material for greater insulative properties. The panes may be spaced to optimise the heat insulative properties or alternatively, the spacing may be to optimise noise insulative properties.

Preferably, each multiple pane unit is provided without peripheral frame members holding the panes together. In a preferred form of the invention, the multiple panes may be held together with the seal disposed therebetween by an appropriate adhesive. In a most preferred form, the edges are finished off with an elastomeric sealant filling any peripheral gaps, with the edges of the panes polished to thereby present aesthetically appealing edges. In a most preferred form of the invention, the seal and/or the adhesive is transparent or translucent and a clear sealant/filler is used.

The window may be presented in a double hung configuration or a horizontal sliding configuration. In the double hung configuration there are suitably two multiple pane units arranged in a counterbalanced configuration. The counterbalancing may be achieved by a cord interconnecting the two pane units with the cord extending around a pulley so that upward or downward movement of one pane unit causes a corresponding downward or upward movement of the other pane unit. Alternatively one of the multiple pane units may be counterbalanced by a weight. In another embodiment, one or more multiple pane units may be counterbalanced by a spring or other supporting mechanism.

Suitably, the at least one multiple pane unit is mounted within a frame to support the sliding movement.

In accordance with a second aspect of the present invention there is provided a window including at least two multiple pane units mounted in an opening wherein at least one of the multiple pane units is moveable between an open and a closed position, and wherein each multiple pane unit comprises at least two panes in spaced disposition and has a seal disposed therebetween to form a sealed chamber between the two panes, such that in the closed positions of the or each moveable multiple pane unit, portions of the seal of the multiple pane units are aligned and wherein at least one of the multiple pane units has at least one of its panes extending beyond the seal.

Preferably, the extension is so as to overlap the other multiple pane unit.

In a preferred form of the invention, the window may be of the double hung type, in which case there is an upper multiple pane unit and a lower multiple pane unit. Preferably, the bottom of the upper multiple pane unit extends beyond the seal to overlap the lower multiple pane unit. The extension may be about 70 mm but anywhere between 50 mm and 150 mm may be aesthetically acceptable. In the double hung configuration, preferably it is the exterior pane of the upper multiple pane unit which is extended. Alternatively, it may be the interior pane. In another form of the invention, both panes may be extended. Sealing strips referred to as "lap seals" may be provided to seal gaps between the multiple pane units. These lapseals may have bristles to assist with sealing. The lapseals may be removable.

In the double hung configuration, the aligned portions of the seal may comprise a top portion of the lower pane unit and a bottom portion of the upper pane unit.

The above aspect of the invention may also be applied to horizontal sliding windows in which case the aligned portions of the seal will extend vertically centrally of the window.

In accordance with a third aspect of the present invention, there is provided a window including at least two multiple pane units mounted in an opening with at least one of the multiple pane units mounted for sliding movement in a sliding plane between an open position and a closed position wherein each multiple pane unit includes at least two panes in spaced disposition and has a seal disposed therebetween to form a sealed chamber between the two panes, wherein, in the closed position, the at least two multiple pane units overlap in the sliding plane forming an overlapped region and at least one of the multiple pane units has an outer one of its panes extending beyond the seal, wherein a sealing strip is disposed in the overlapped region such that both multiple pane units engage with the sealing strip in the closed position.

In a preferred form of the invention, both multiple pane units may have their outer panes extended. Further, lap seals may be provided at the edges of the extended panes to engage with the inner pane of the adjacent multiple pane unit.

The terms "exterior/external" and "interior/internal" apply to the environment of the window i.e. whether on the outside relative to the building (exterior/external) (internal/interior) or on the inside relative to the building. On the other hand the terms "inner" and "outer" refer to the relative position of the pane within the window assembly.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following give examples.

BRIEF DESCRIPTION OF THE DRAWINGS

In order that the invention maybe more fully understood, some embodiments will now be described by way of example for reference to the Figures in which:

FIGS. 1 to 6 are prior art drawings discussed above;

DETAILED DESCRIPTION OF THE PREFERRED EMBODIMENTS

Figure 1:
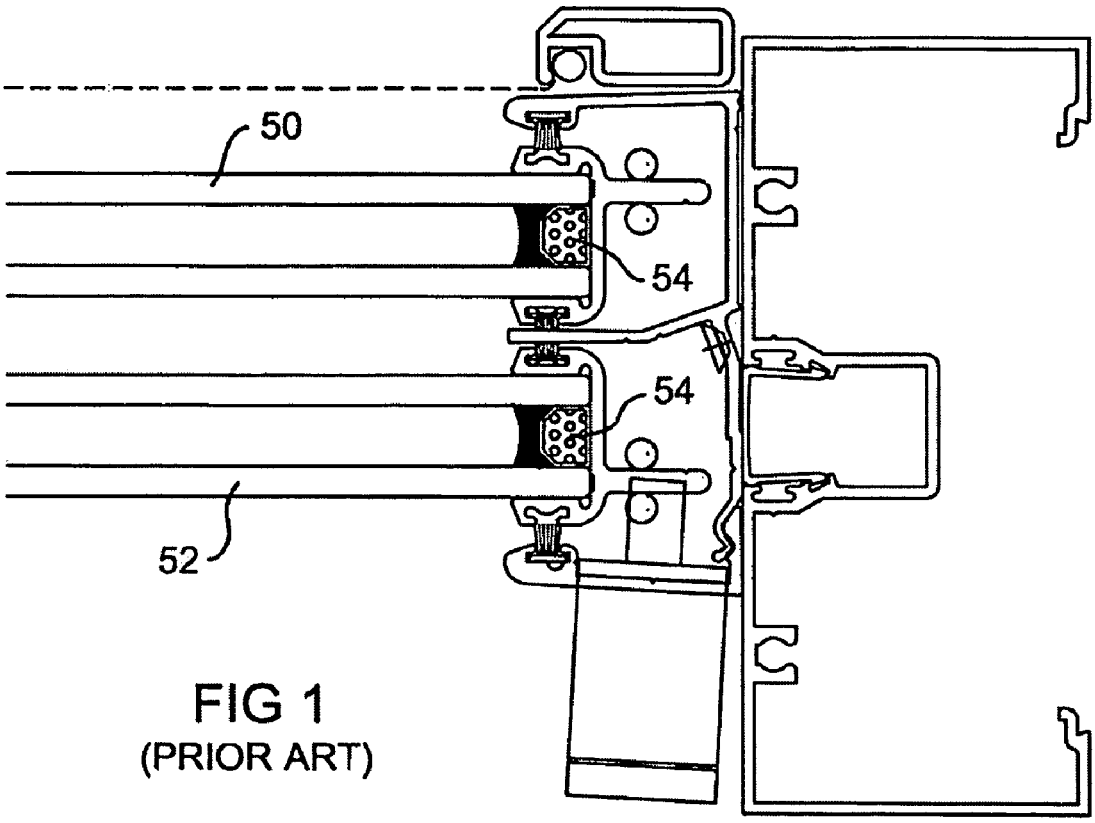
FIG 1 (PRIOR ART)
Figure 2:
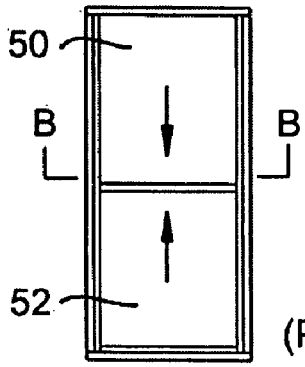
FIG 2 (PRIOR ART)
Figure 5A:
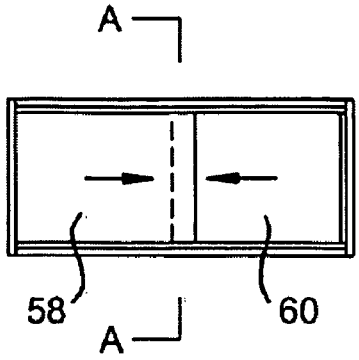
FIG 5a (PRIOR ART)
Figure 5B:
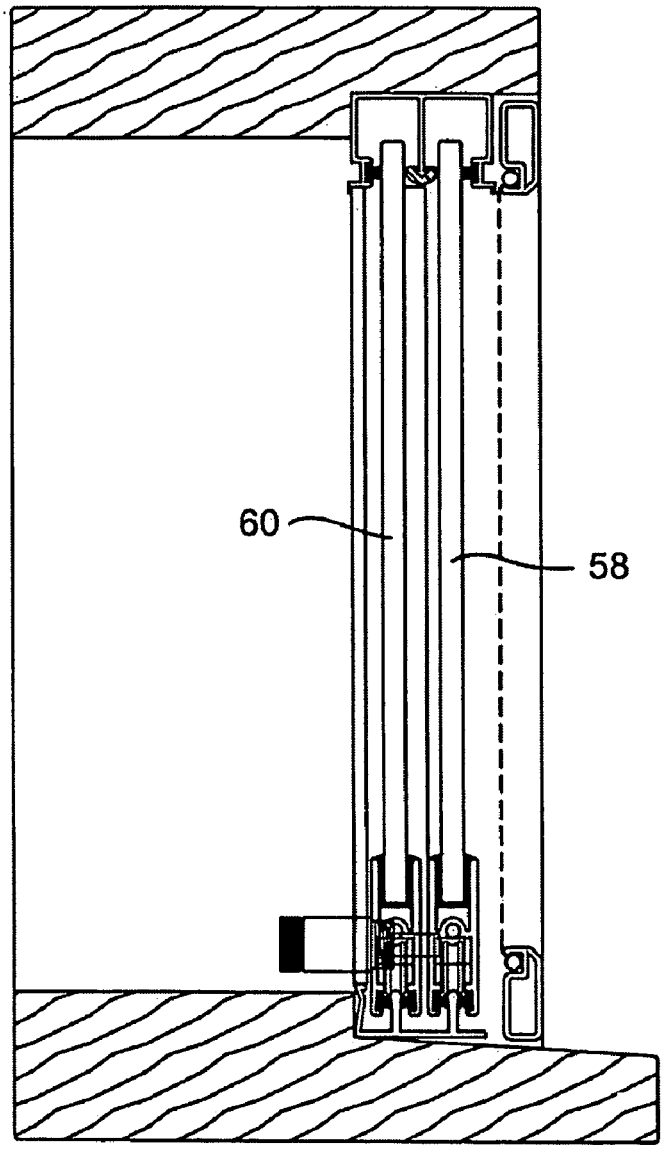
FIG 5b (PRIOR ART)
Figure 6A:
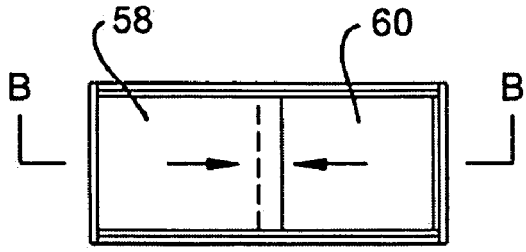
FIG 6a (PRIOR ART)
Figure 6B:
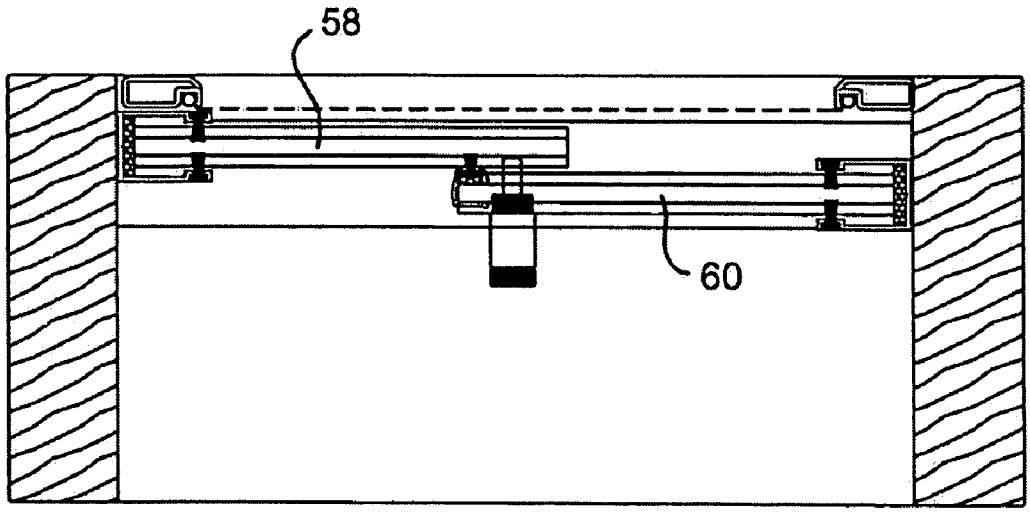
FIG 6b (PRIOR ART)
Figure 7A:
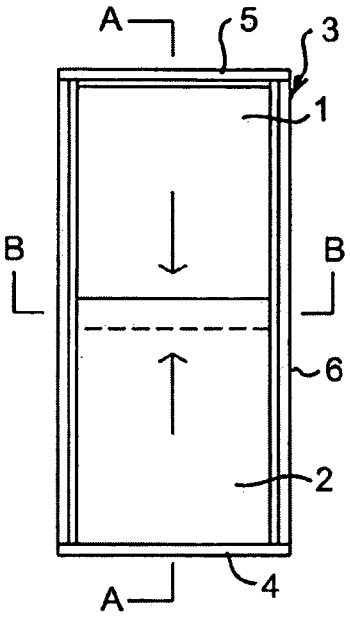
FIGS. 7*a* to 7*f* are front views of different configurations of vertical sliding sashless windows according to preferred embodiments of the present invention.

Different types of sashless double hung windows are shown in FIGS. 7*a* to 7*e*. The window shown in FIG. 7*a* is a standard two pane unit, double hung window with two counterbalanced pane units 1 and 2 mounted for relative sliding movement in a frame 3. In the closed position of the window, the pane units 1 and 2 overlap slightly and are connected by at least one cord extending around a pulley in the conventional manner. The arrangement is such that an upward movement of the lower pane unit 2 leaves an opening between the lower pane and the bottom frame member 4 and causes a corresponding downward movement of the upper pane to leave another opening between the upper pane unit 1 and the top frame member 5.

Figure 7B:
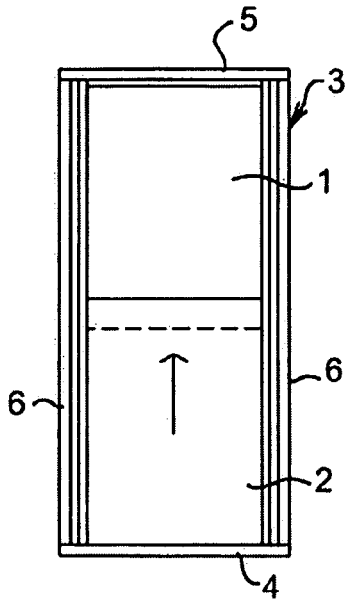
Figure 7C:
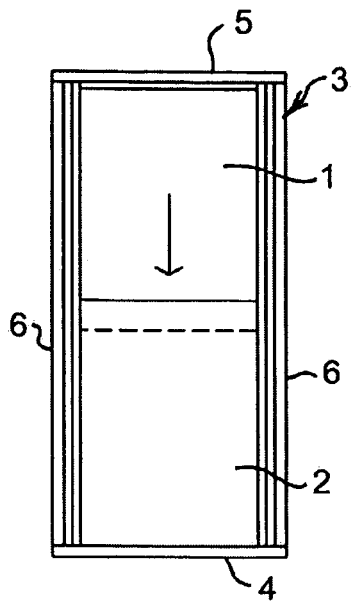

In the servery type window or hatch of FIG. 7*b*, the upper pane unit is fixed in the frame 3 and the lower pane unit is connected by a cord to a counterbalanced weight. When the lower pane unit 2 is moved upwards, an opening is created between the bottom frame member 4 and the lower pane unit 2. FIG. 7*c* shows a similar type of servery window, but with the lower pane unit 2 fixed, and the upper pane unit moveable within the frame 3 so that when the upper pane unit is moved downwards, an opening is formed between the upper pane unit 1 and the top frame member 5.

Figure 7D:
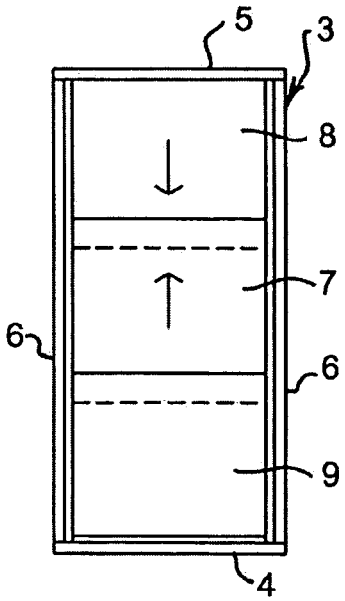
Figure 7E:
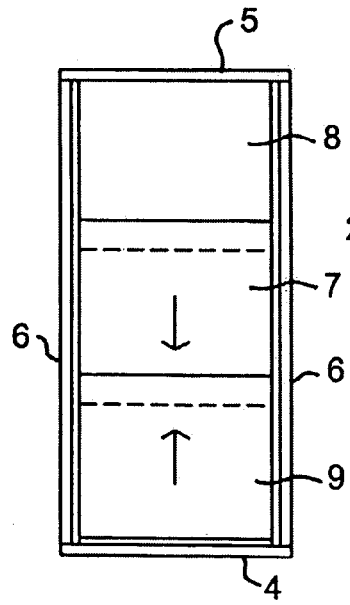

Two further types of sashless double hung windows, each having three pane units are shown in FIGS. 7*d* and 7*e*. In the three pane unit system of the FIG. 7*d*, the bottom pane unit 9 is fixed and the other two pane units 7 and 8 are relatively moveable within the frame. The arrangement is such that upward movement of the middle pane unit to create an opening between the middle pane unit 7 and the bottom pane unit 9 causes a corresponding downward movement of the top pane unit to form an opening between the top pane unit and top frame member 5. This arrangement is reversed in the three-pane unit window system of FIG. 7*e* in which the top pane unit is fixed and the other two pane units 7 and 9 are relatively moveable. In this arrangement, upward movement of the bottom pane unit 9 to create an opening between the bottom pane unit 9 and the bottom frame member 4 causes a corresponding downward movement of the middle pane unit 7 to form an opening between the middle pane unit 7 and the top pane unit 8.

Figure 7F:
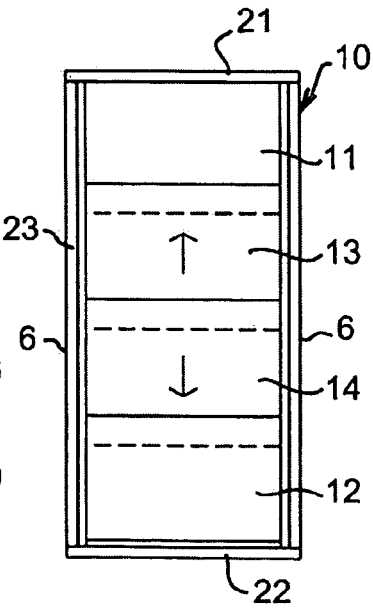
Figure 7G:
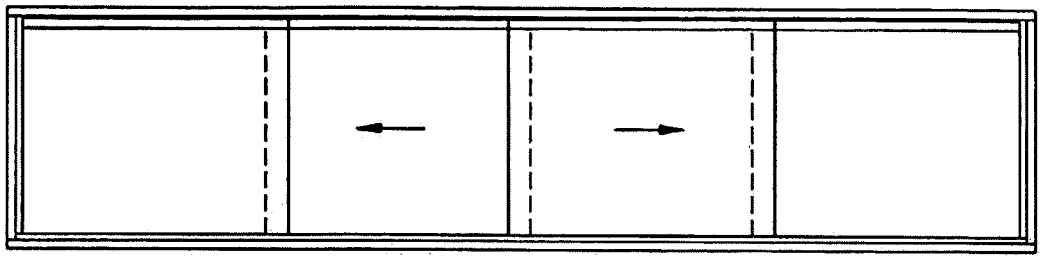
FIGS. 7*g* to 7*j* are front views of different configurations of horizontal sliding sashless windows according to preferred embodiments of the present invention.
Figure 7H:
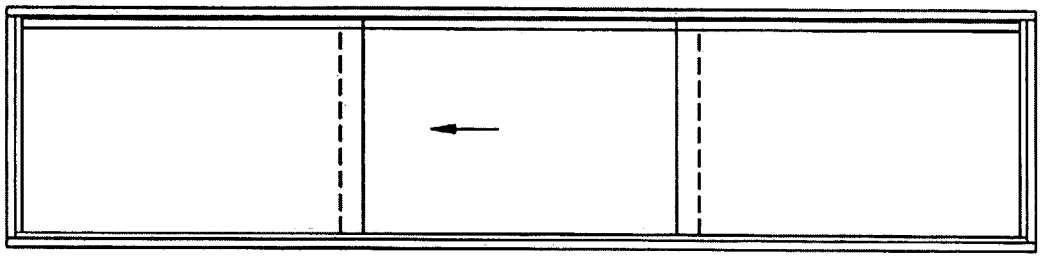
Figure 7I:
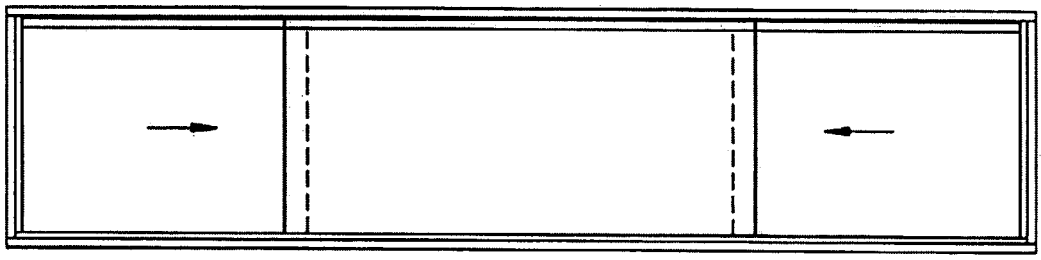
Figure 7J:
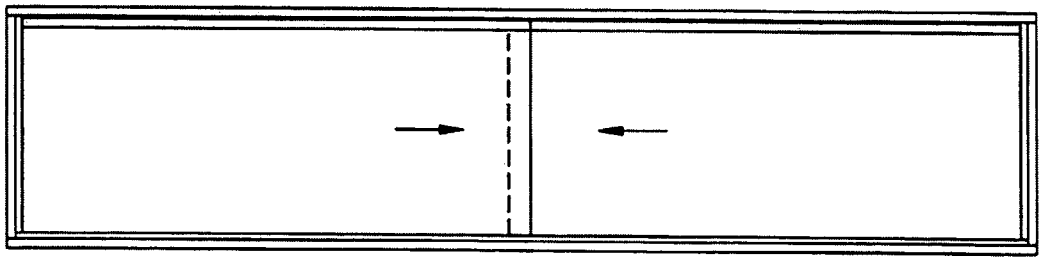

The sashless double hung window of FIG. 7*f* differs from the windows of FIGS. 7*a* to 7*e* in that it has four pane units 11, 12,13 and 14 mounted in a fixed window frame 10. The top and bottom pane units 11 and 12 are fixed relative to the frame 10 and first and second intermediate counterbalanced pane units 13 and 14 are slidably moveable within the frame 10. The intermediate panes 13 and 14 are counterbalanced by being connected by at least one cord extending around a pulley and the arrangement is such that the intermediate panes 13 and 14 are movable from a first, closed position into a second, open position in which an opening is formed between the intermediate panes 13 and 14.

FIGS. 7*g* to 7*j* show four different configurations of horizontal sliding windows but other configurations are possible.

Figure 8:
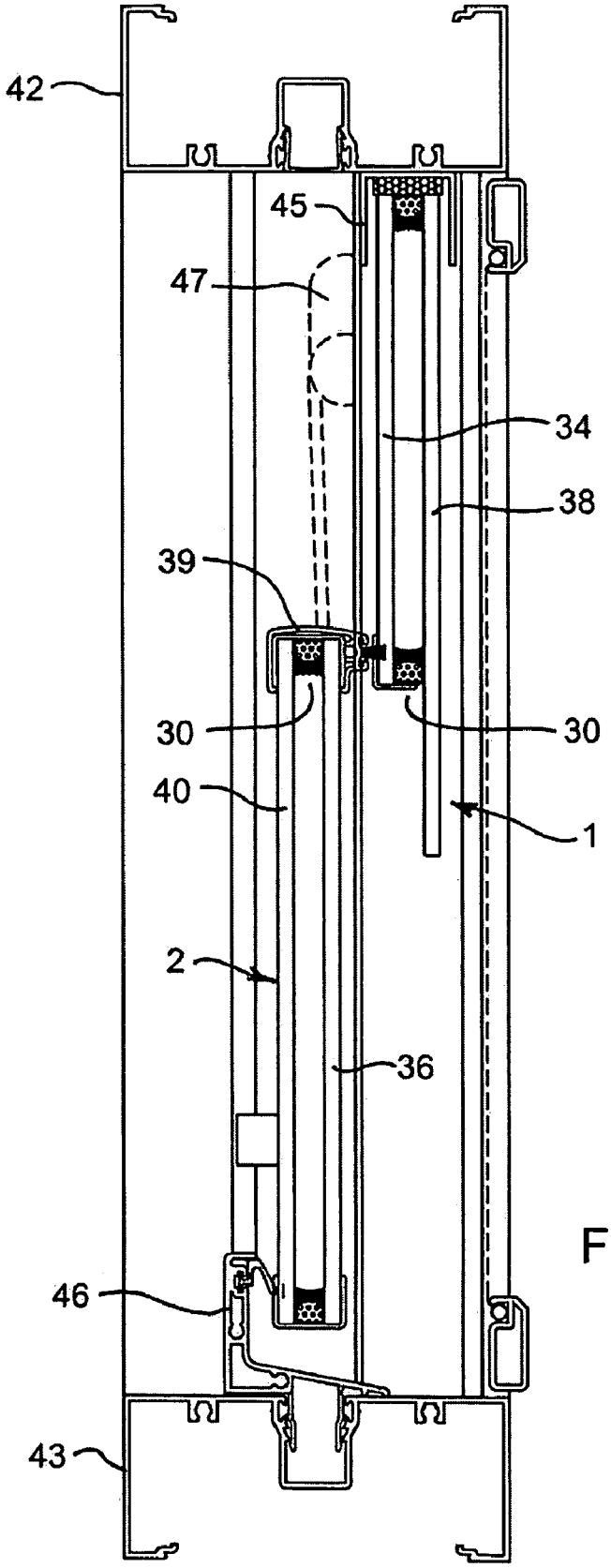
FIG. 8 is a vertical cross-sectional view through A-A of FIG. 7*a;*

The window illustrated in FIG. 8 comprises two multiple pane units 1, 2 as corresponding to FIG. 7*a*. Each multiple pane unit comprises two spaced panes of glass or other material having a seal 30 provided therebetween. The edges of the panes may be polished and further, a filler or other sealant material (not shown) may be provided to present an appealing finished edge. The two panes and the seal may be held together by an appropriate adhesive. Accordingly, the pane units 1, 2 are rimless.

Terms such as interior/internal pane and exterior/external pane will be used to refer to the two panes making up the pane units 1, 2. The term "external pane" is used to refer to the external pane when considering the environment of the window, for example, external panes 36, 38 face the outside, whereas internal panes 34, 40 face the inside. It can be seen that external pane 38 has its lower edge extended beyond the seal 30 to overlap the lower pane unit 2. Optionally, external pane 36 may have its lower edge extended beyond the seal 30.

Optionally, a lap seal 39 may be provided which is a sealing strip having a brush pile with optionally an elastomeric swipe blade. Suitably, the lap seal is of transparent or translucent material.

Figure 9:
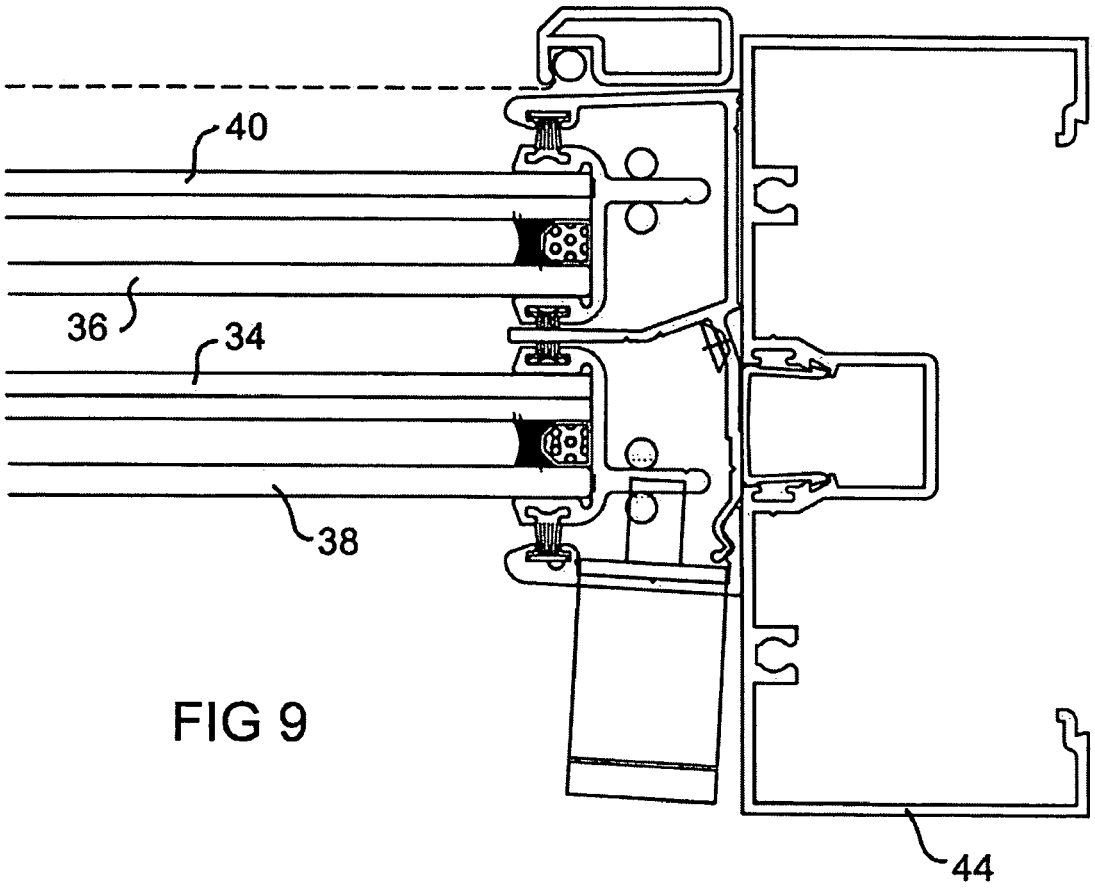
FIG. 9 is a horizontal cross section view through B-B of FIG. 7*a;*

As shown in FIGS. 8 and 9, the two units 1, 2 are mounted within a window frame including head 42, sill 43 and side jambs 44. A head channel 45 is provided at the head 42 and the top of unit 1 is received in the head channel 45 in the closed position. At the sill, a sill adaptor 46 is provided with a gradient towards the outside. A pulley and cord arrangement 47 interconnects the two units 1, 2.

Other arrangements are evident from the configurations illustrated in FIGS. 10 through 15 and like numerals represent like parts and the prime (') indicating a similar part.

Figure 10:
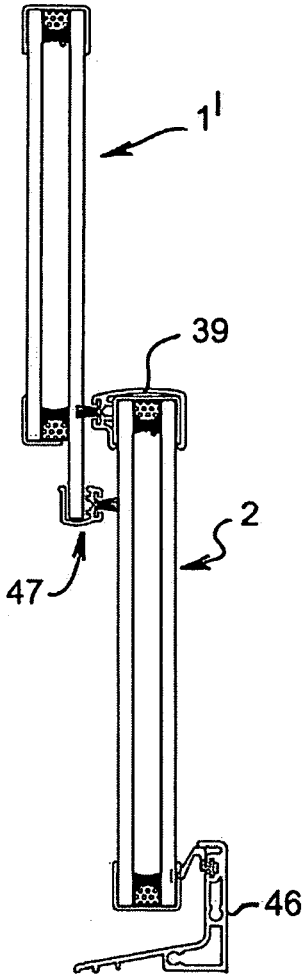
FIG. 10 is a alternative configuration for the cross-section through C-C of FIG. 7*a*, illustrating the downward extension of the inner pane of the upper multiple pane unit with an additional lapseal provided at the extended edge.
Figure 11:
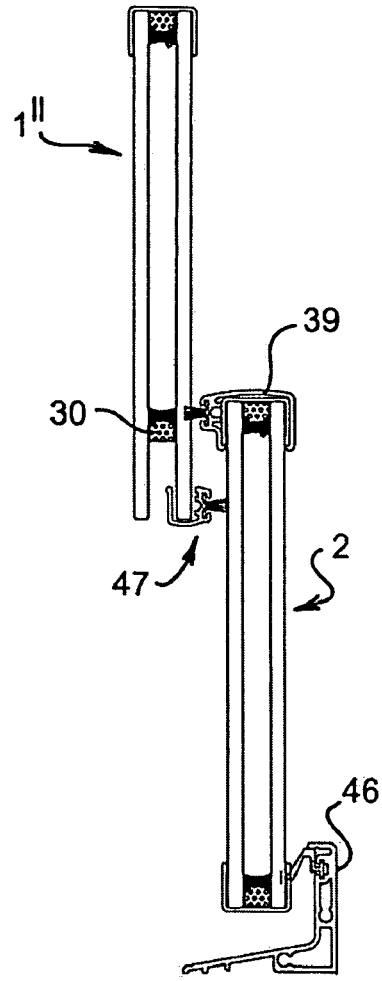
FIG. 11 is a variation of FIG. 10 illustrating additionally the outer pane of the upper multiple pane unit being extended downwardly.
Figure 12:
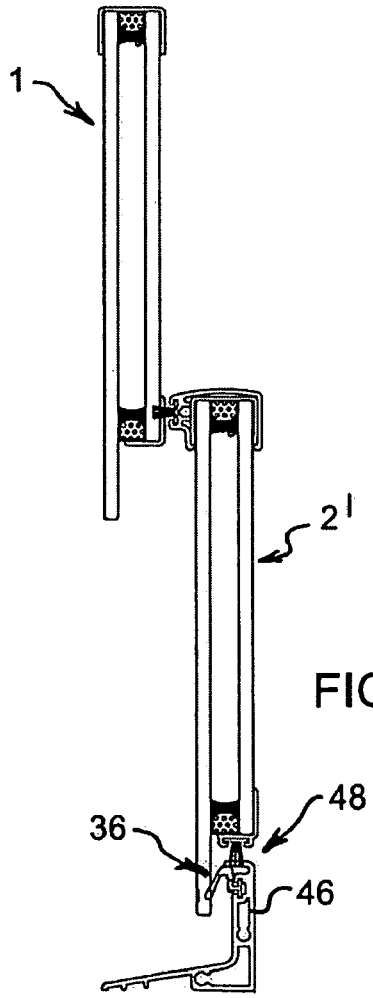
FIG. 12 is yet another modification of FIG. 10 illustrating that the inner pane of the lower pane unit may be extended downwardly to overlap with the extruded aluminium sill.
Figure 13:
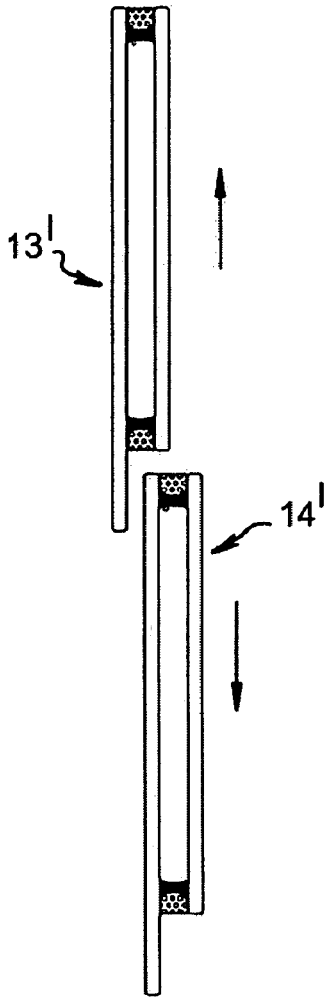
FIG. 13 is a vertical cross-sectional detail through a window of the type shown in FIG. 7*f* where two central pane units move away from each other to open, whereby the outer pane of the upper pane unit and the inner pane of the lower pane unit are both extended downwardly and the pane units overlap in the sliding plane.

In FIG. 10, the extended pane is provided with a sealing strip 47. In FIG. 11, both panes of unit 1" have been extended past seal 30. FIG. 12 shows an alternative arrangement for the bottom unit 2' having external pane 36 extended to seal against the sill adaptor 46. Additional seals 48 may be provided to seal against the sill adaptor 46. A similar arrangement could be used at the head 42.

On 4-pane or like systems (see for example FIGS. 7*f* and 7*g*) where two panes move away from each other then the units can be more or less aligned in the sliding plane i.e., overlapping, with a slight offset to allow for the extended pane of one of the units to overlap with the other unit. The arrows indicate the direction of opening.

Figure 14:
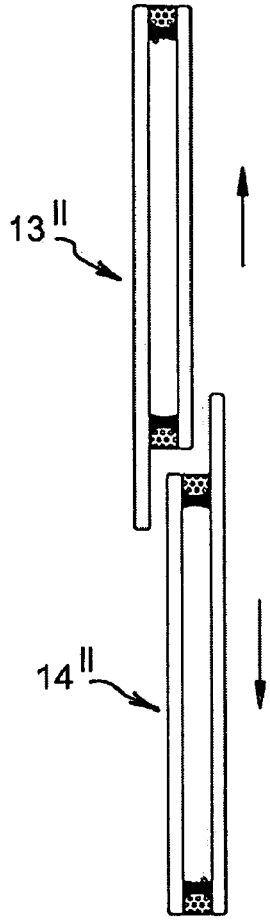
FIG. 14 is another variation of FIG. 13 whereby the lower pane unit has the outer pane extended upwardly.
Figure 15:
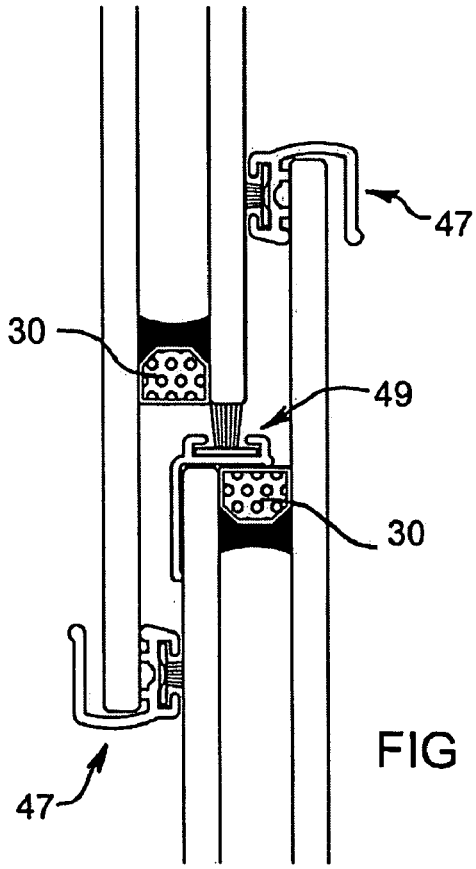
FIG. 15 illustrates a detail of FIG. 14, illustrating the disposition of lap seals on the extended edges of the outer panes and also the provision of a sealing strip disposed in an overlapped region on one of the multiple pane units to engage with the other multiple pane unit in the closed configuration.

FIG. 15 is a detailed view of FIG. 14 illustrating various lap seals 47, 49 that might be incorporated.

The foregoing only describes some of the embodiments of the present invention and modifications may be made thereto without departing from the scope of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A window comprising:

a first pane assembly mounted in an opening, the first pane assembly comprising:

a first pane;

a second pane; and a first seal disposed between the first and second panes to form a sealed chamber between the first and second panes; and a second pane assembly also mounted in the opening, at least one of the first and second pane assemblies being slidable with respect to the other pane assembly between an open position and a closed position, the second pane assembly comprising:

a third pane;

a fourth pane longer than the third pane; and a second seal disposed between the third and fourth panes to form a sealed chamber between the third and fourth panes, wherein when the first and second pane assemblies are in the closed position, the fourth pane of the second pane assembly extends beyond the third pane and beyond the second seal so as to overlap with the first pane assembly.

2. The window as claimed in claim 1 wherein each pane assembly comprises a double glazed unit.

3. The window as claimed in claim 2 wherein each pane assembly is provided without peripheral frame members holding the panes together.

4. The window as claimed in claim 1 wherein the pane assemblies are arranged in a double hung configuration.

5. The window as claimed in claim 4 wherein the pane assemblies are arranged in a counterbalanced configuration.

6. The window as claimed in claim 1 wherein the pane assemblies are arranged in a horizontal sliding configuration.

7. The window as claimed in claim 1 wherein the two pane assemblies are arranged in a double hung configuration with one of the pane assemblies serving as an upper pane assembly and the other serving as a lower pane assembly.

8. The window as claimed in claim 7 wherein the second pane assembly serves as the upper pane assembly, and the bottom of the fourth pane of the upper pane assembly extends beyond the seal to overlap the lower pane assembly.

9. The window as claimed in claim 8 wherein the fourth pane comprises an exterior pane of the second pane assembly.

10. The window as claimed in claim 8 wherein the fourth pane comprises an interior pane of the second pane assembly.

11. The window as claimed in claim 8 wherein the third pane of the second pane assembly also extends beyond the first seal of the lower pane assembly.

12. The window as claimed in claim 1 wherein the extension of the fourth pane beyond the second seal is in the range of 50 mm and 150 mm.

13. The window as claimed in claim 1, further comprising sealing strips to seal gaps between the pane assemblies.

14. The window as claimed in claim 13 wherein the sealing strips are removable.

15. The window as claimed in claim 13 wherein the sealing strips are comprised of translucent or transparent material.

16. The window as claimed in claim 1 wherein the two pane assemblies are arranged in a horizontal sliding configuration with aligned portions of the seals extending vertically centrally of the window.

* * * * *